US005755319A

United States Patent [19]

Szymanski et al.

[11] Patent Number: 5,755,319

[45] Date of Patent: May 26, 1998

[54] SAFETY POWER SWITCH

[75] Inventors: Donald M. Szymanski, Prospect; Gregory A. Phillips, LaGrange; L. R. Leet, Sr., Shelbyville, all of Ky.

[73] Assignee: Credo Tool Company, Woodburn, Oreg.

[21] Appl. No.: 708,240

[22] Filed: Sep. 3, 1996

[51] Int. Cl.[6] ..... H01R 13/70

[52] U.S. Cl. ..... 200/43.02; 200/43.04; 200/43.16

[58] Field of Search ..... 200/43.02, 43.04, 200/43.22, 43.16, 43.08, 43.11, 42.01, 333, 343, 330; 439/133, 135; 70/DIG. 30

[56] References Cited

U.S. PATENT DOCUMENTS 4,463,228 7/1984 Osika ..... 200/43.02
4,647,735 3/1987 Sicher ..... 439/133
5,486,664 1/1996 Lamp et al. ..... 200/43.22

*Primary Examiner*—David J. Walczak
*Attorney, Agent, or Firm*—McDermott, Will & Emery

[57] ABSTRACT

A power outlet strip having at least one receptacle; a member for receiving power from a power source; a switch coupled between the receptacle and the member for receiving power, which operates to control power transfer to the receptacle; a sliding member; and a safety key for controlling the position of the sliding member. When the safety key is engaged in the outlet strip, it positions the sliding member such that the switch is accessible and operable by an operator. When the safety key is removed from the outlet strip, is positions the sliding member such that the switch is inoperable by the operator. The outlet strip also includes a switch cover for covering the switch. The switch cover has at least one leaf spring and an actuating member. The actuating member is operative for toggling the switch to an OFF position when the switch cover is depressed. The leaf spring is operative for maintaining the actuating member above the switch when no pressure is applied to the switch cover.

22 Claims, 3 Drawing Sheets

SAFETY POWER SWITCH

BACKGROUND OF THE INVENTION

1. Field of the Invention

The present invention relates generally to electrical switches, and more particularly, to an electrical safety outlet strip for use with a conventional electrical wall receptacle or the like.

2. Description of Related Art

Switches for enabling and/or disabling electrical wall receptacles are well known in the art. For example, U.S. Pat. No. 4,080,518 discloses a wall mountable receptacle having an integral rocker switch for selectively turning the receptacle power on and off as desired. Similarly, U.S. Pat. No. 3,846,598 discloses a wall mounted receptacle having internal switch means which is activated by insertion of the grounding prong on the plug of the appliance to be plugged into the receptacle.

Other known devices for enabling and/or disabling electrical wall receptacles include outlet strips, also referred to as strip lines. Such outlet strips typically comprise a plurality of receptacles for receiving the power cords of multiple appliances, a single power cord extending back to the wall receptacle, and a switching means for enabling and/or disabling the power to the plurality of receptacles.

Often times, such strip lines are utilized to extend electrical power from the wall receptacle to, for example, a work bench. In such cases, it is critical that the strip line provide safety features to the prevent the inadvertent operation of the switch so that power tools, such as a router, cannot be unintentionally activated. Such safety features are necessary to prevent severe injuries which often result from the inadvertent activation of power tools. Heretofore, however, known strip lines lack sufficient safety features.

Accordingly, there exists a need for an apparatus for supplying electrical power from a fixed receptacle to distant receptacles that substantially eliminates the possibility of inadvertently supplying power to the distant receptacles.

SUMMARY OF THE INVENTION

The present invention relates to a switched safety outlet strip which prevents an ON/OFF switch contained in the outlet strip from being inadvertently toggled to the on position, and therefore substantially eliminates the possibility of inadvertently supplying power to receptacles contained within the outlet strip. As such, the novel apparatus of the present invention minimizes the likelihood of inadvertently activating appliances plugged into the outlet strip.

Accordingly, the present invention relates generally to a outlet strip comprising at least one receptacle; means for receiving power from a power source; a switch coupled between the receptacle and the means for receiving power, which operates to control power transfer to the receptacle; a sliding member; and a safety key for controlling the position of the sliding member. When the safety key is engaged in the outlet strip, it positions the sliding member such that the switch is accessible and operable by an operator. When the safety key is removed from the outlet strip, the sliding member is positioned such that the switch is inoperable by the operator.

The outlet strip of the present invention further comprises a switch cover for covering the switch. According to the present invention, the switch cover comprises at least one leaf spring and an actuating member. The actuating member is operative for toggling the switch to an OFF position when the switch cover is depressed. The leaf spring is operative for maintaining the actuating member above the switch when no pressure is applied to the switch cover.

As described in detail below, the apparatus of the present invention provides important advantages over the prior art. Most importantly, the present invention prevents the ON/OFF switch of the outlet strip from being inadvertently toggled to the ON position. As a result, the present invention minimizes the possibility of inadvertently activating appliances plugged into the outlet strip.

Another advantage of the present invention is that it provides a safety key which when removed causes the ON/OFF switch to be physically disabled, thereby preventing the switch from being toggled to the ON position.

Yet another advantage is that the present invention provides a switch cover which when closed functions to toggle the ON/OFF switch to the OFF position. The switch cover, which exhibits a substantially larger surface area than the ON/OFF switch, and which is readily accessible to the operator, allows the operator to turn off an appliance in a rapid, easy manner.

Additional advantages of the present invention will become apparent to those skilled in the art from the following detailed description of exemplary embodiments, which exemplify the best mode of carrying out the invention.

The invention itself, together with further objects and advantages, can be better understood by reference to the following detailed description and the accompanying drawings.

DETAILED DESCRIPTION OF EXEMPLARY EMBODIMENTS

Figure 1A:
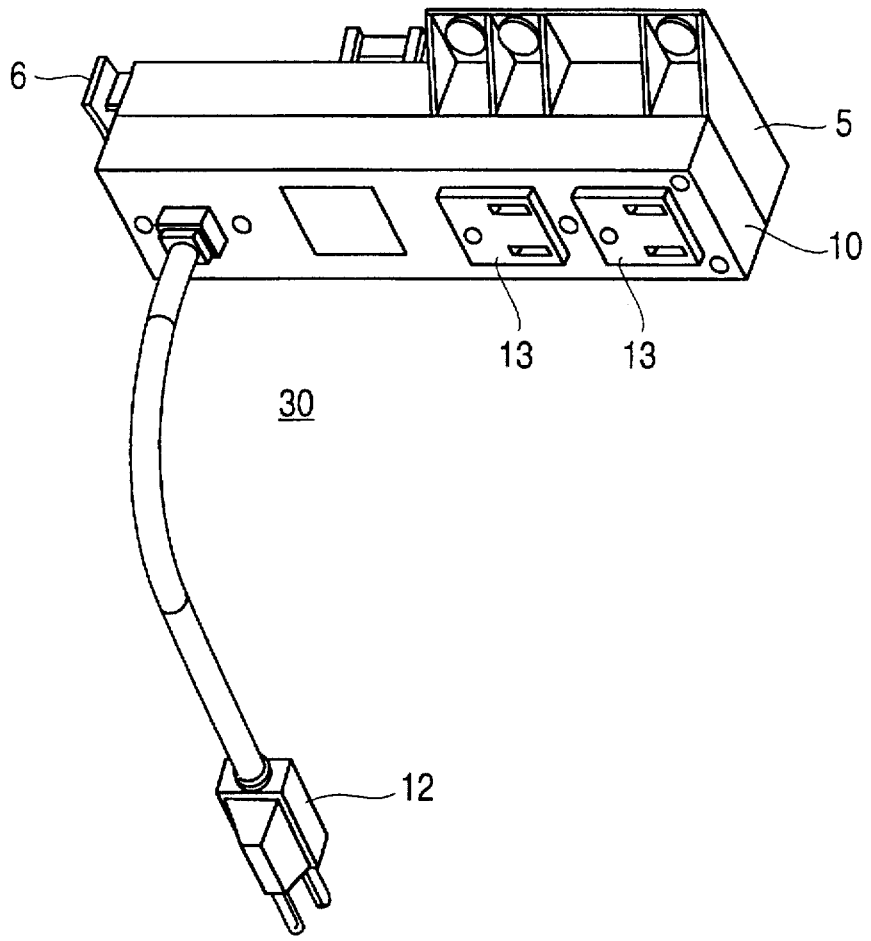
FIGS. 1(*a*) and (*b*) are substantially front and rear views, respectively, of a outlet strip designed in accordance with the present invention.
Figure 1B:
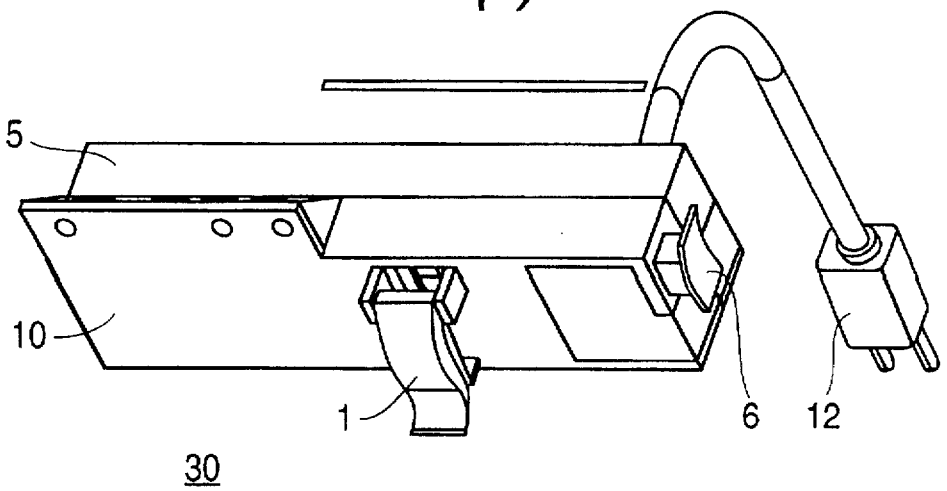

FIGS. 1(*a*) and (*b*) illustrate an exemplary embodiment of an outlet strip designed in accordance with the present invention. As shown, the outlet strip 30 comprises a power cord 12, top housing 5, bottom housing 10, a plurality of receptacles 13, a safety key 6, a power switch 4 and a switch cover 1. As explained in further detail below, the outlet strip 30 functions to deliver electrical power to a plurality of appliances, and provides means for disabling power from being delivered to the appliances.

Figure 2:
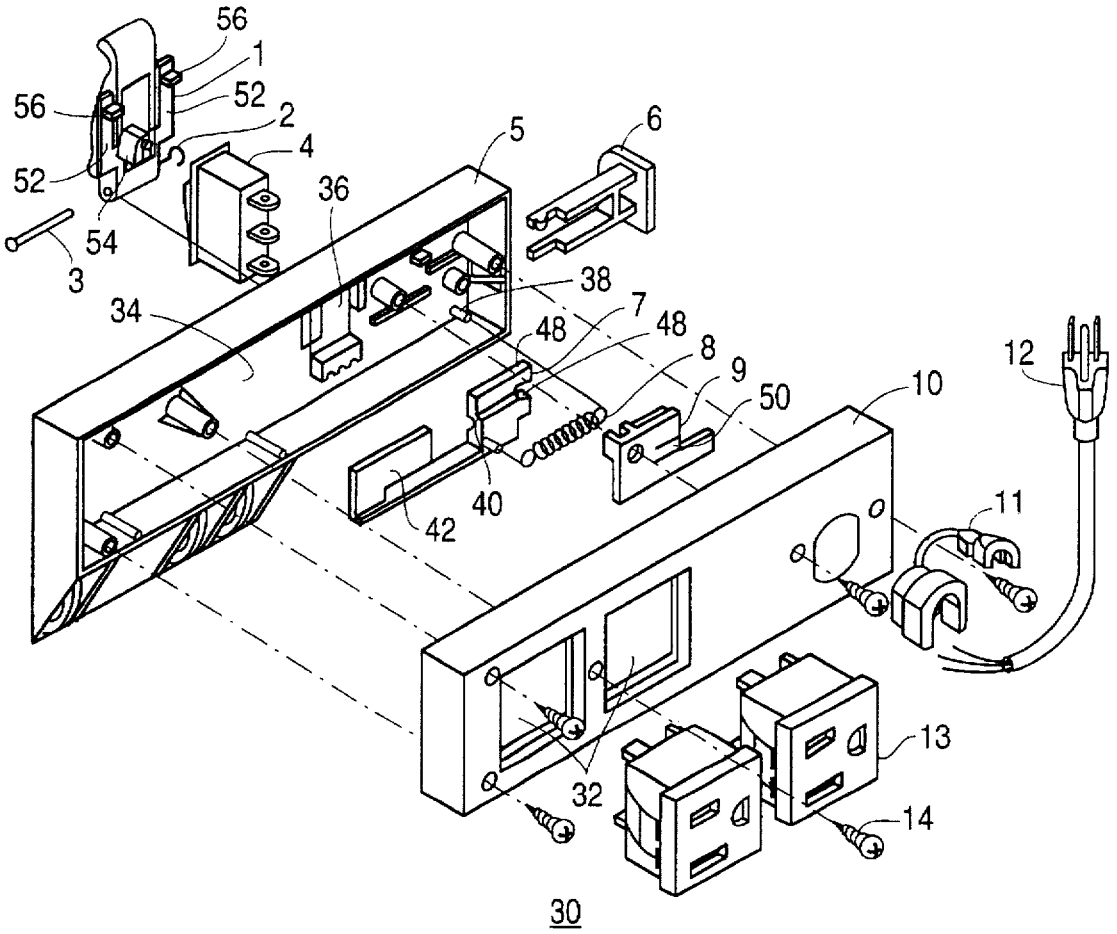
FIG. 2 is an exploded view illustrating the design of the outlet strip of the present invention.

FIG. 2 illustrates the design of the outlet strip 30 of the present invention in more detail. Specifically, as shown, the receptacles 13 are secured to the base housing 10 via deformable plastic members which function to deflect inwardly as each receptacle 13 is positioned within the respective openings 32 in base housing 10. Once the plastic members pass over a ledge created in the openings 32, the plastic members extend outwardly, thereby preventing removal of the receptacles 13. The power cord 12 is also secured to the base housing 10 via strain relief apparatus 11.

Each of the receptacles 13 is coupled to the power cord 12 via power switch 4, which has two positions ON and OFF.

In the ON position, the power switch 4 enables the receptacles (i.e., power present at receptacles), and in the OFF position, the receptacles are disabled (i.e., no power present at the receptacles.) The power switch 4 is mounted to the top housing 5 such that the upper surface of the power switch 4 resides below the lower surface 34 of the top housing 5. The power switch can be held in place, for example, by deformable members extending downwardly from the lower surface 34, which expand outwardly upon insertion of the power switch 4, and then retract to hold the power switch 4 in place. For example, the deformable members can be formed with detents, and the power switch 4 can be formed with a complementary engagement member, which functions in conjunction with the detents to secure the power switch 4 in the desired position. Further, power switch 4 comprises an internal breaker to interrupt the current flow in the event of an overload situation. Such a power switch 4 is illustrated for example in U.S. Pat. No. 5,262,748.

Importantly, however, the power switch 4 is positioned such that a movable or sliding plate 7 (also referred to as a movable or sliding member) can pass between the lower surface 34 of the top housing 5 and the upper surface of the power switch 4. Sliding plate 7 is movably mounted and operates in conjunction with the safety key 6 to prevent the power switch from being toggled to the ON position when the key is removed.

More specifically, referring to FIG. 2, the sliding plate 7 is mounted to the top housing 5 via a fixed plate 9 and a spring 8. Fixed plate 9 in conjunction with the lower surface 34 of the top housing 5 functions to form a slot for movement of the sliding plate 7. As shown, the fixed plate 9 has an L-shaped cross section so as to create the area between itself and the top housing 5, and is secured to the top housing 5 by a screw. One end of the spring 8 is secured to a post 38 located on the top housing 5, and the other end is secured to a post 40 on the sliding member 7. When the safety key 6 is removed, the spring 8 functions to retract the sliding member 7 such that a blocking portion 42 of the sliding member is positioned in opening 36, thereby physically preventing switch 4 from being toggled to the ON position. In the present embodiment, the blocking portion covers substantially half of the switching mechanism of switch 4 so as to physically prevent the switch from being turned to the ON position. However, it is also possible to design the sliding plate 7 and associated elements such that the sliding plate 7 completely covers the switch 4.

Figure 3A:
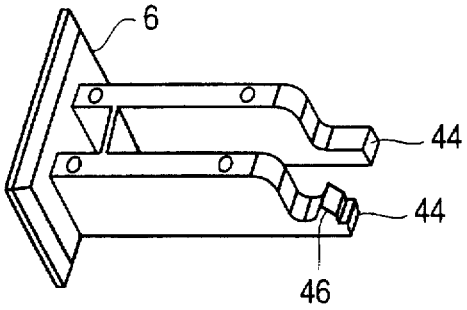
FIGS. 3(*a*) and (*b*) are substantial front and rear views, respectively, of the safety key forming part of the outlet strip of the present invention.
Figure 3B:
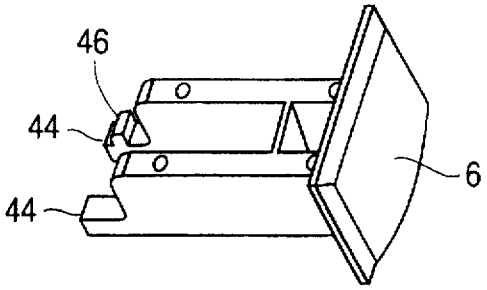

In order to operate the power switch 4, the safety key 6 must be inserted in the outlet strip 30. Referring to FIGS. 2 and 3, in the current embodiment, the safety key 6 exhibits a T-shaped cross section and has two extending legs 44, one of which comprises a latching member 46 disposed thereon. In operation, the two extending legs 44 are inserted into corresponding openings (not shown) in the top housing 5. Upon insertion, the two legs 44 engage members 48 on the sliding plate 7. As the safety key 6 is pushed further into the outlet strip 30, the sliding plate 7 is driven downward against the force of the spring 8. The safety key 6 is completely inserted once the latch member 46 engages a complementary latch member 50 disposed on the fixed plate 9. With the safety key 6 inserted, the position of the sliding plate 7 is such that an opening in the sliding plate 7 aligns with the opening 36 in the top housing 5 so as to allow access to the power switch 4. Latch member 50 operates in conjunction with latch member 46 to retain the safety key 6. Both latch member 46 and latch member 50 are deformable and resilient such that the safety key 6 can be repeatedly removed and re-inserted.

Figure 4A:
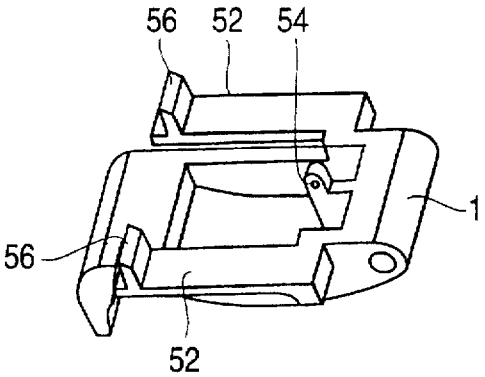
FIGS. 4(*a*) and (*b*) are substantial front and rear views, respectively, of the switch cover forming part of the outlet strip of the present invention.
Figure 4B:
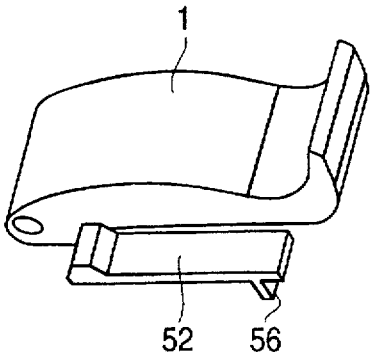

The outlet strip 30 of the present invention also comprises a novel switch cover 1. As shown in FIGS. 2 and 4, the switch cover 1, which is hinged to the top housing 5 via a pin 3 and clip 2, comprises two bias members 52, such as, leaf springs, and an actuating member 54. The leaf springs 52, which extend substantially parallel to the main body of the switch cover 1, operate to position the actuating member 54 slightly above the switch 4. In other words, when no pressure is applied, the actuating member 54 does not contact the switch 4. However, if pressure is applied to the switch cover 1, the leaf springs 52 flex such that the actuating member 54 engages the switch 4 and toggles the switch 4 to the OFF position. Upon removal of the pressure, the leaf springs 52 return the actuating member 54 to the non-contacting position.

In the current embodiment, actuating member 54 extends downwardly below the lower surface of the leaf springs 52 a length sufficient such that it depresses switch 4 when the leaf springs 52 are flexed. Each leaf spring 52 further comprises a downwardly extending leg 56 which is utilized to properly position the actuating member 54, and provide room for the necessary flexibility. Further, according to the current embodiment, the switch cover 1 is molded from plastic so as to be a single, unitary member.

The switch cover 1 of the present invention performs various functions. For example, it acts as a safety device by requiring the operator to lift the switch cover 1 before manually toggling the switch 4 to the ON position. This prevents inadvertent operation of the switch 4, if the switch 4 is unintentionally bumped or brushed. The switch cover 1 also functions to toggle the switch 4 to the OFF position when the operator depresses the switch cover 1 against the switch 4. Accordingly, the operator is provided a quick and easy means for deactivating the switch. This results in part from the switch cover 1 having a substantial larger surface area than the switch 4.

The present invention provides important advantages over the prior art. Most importantly, the present invention prevents the ON/OFF switch of the outlet strip from being inadvertently toggled to the on position. As a result, the present invention minimizes the possibility of inadvertently activating appliances plugged into the outlet strip.

Another advantage of the present invention is that it provides a safety key which when removed causes the ON/OFF switch to be physically unaccessible, thereby preventing the switch from being toggled to the ON position.

Yet another advantage is that the present invention provides a switch cover which when closed functions to toggle the ON/OFF switch to the OFF position. The switch cover, which exhibits a substantially larger surface area than the ON/OFF switch, and which is readily accessible to the operator, allows the operator to turn off an appliance in a rapid manner.

Of course, it should be understood that a wide range of changes and modifications can be made to the exemplary embodiments described above. It is therefore intended that the foregoing detailed description be regarded as illustrative rather than limiting and that it be understood that it is the following claims, including all equivalents, which are intended to define the scope of this invention.

What is claimed is:

1. An outlet strip comprising:

at least one receptacle;

means for receiving power from a power source;

a switch coupled between said receptacle and said means for receiving power, said switch operative for controlling power transfer to said at least one receptacle;

a movable member; and a safety key; said safety key having an engaged position and a disengaged position;

said safety key in said engaged position operative for positioning said movable member such that said switch is accessible and operable by an operator, said safety key in said disengaged position operative for positioning said movable member such that said switch is inoperable by said operator.

2. An outlet strip according to claim 1, wherein said safety key comprises a latching member operable with a complementary latch member disposed on a fixed plate within said outlet strip so as to secure said safety key in said engaged position.

3. An outlet strip according to claim 1, wherein said safety key repeatedly movable between said engaged position and said disengaged position.

4. An outlet strip according to claim 1, wherein said movable member prevents said switch from being toggled to an ON position when said safety key is in said disengaged position.

5. An outlet strip according to claim 1, wherein said movable member completely covers said switch such that the switch is inaccessible when said safety key is in said disengaged position.

6. An outlet strip according to claim 1, wherein said switch comprises an internal breaker circuit.

7. An outlet strip comprising:

at least one receptacle;

means for receiving power from a power source;

a switch coupled between said receptacle and said means for receiving power, said switch operative for controlling power transfer to said at least one receptacle; and a switch cover for covering said switch, said switch cover having at least one bias member and an actuating member, said actuating member operative for toggling said switch to an OFF position when said switch cover is depressed, said at least one bias member operative maintaining said actuating member above said switch when no pressure is applied to said switch cover.

8. An outlet strip according to claim 7, wherein said switch cover is molded from plastic so as to form a single, unitary member.

9. An outlet strip according to claim 7, wherein said switch cover comprises two bias members, each of which extends substantially parallel to a main body portion of the switch cover.

10. An outlet strip according to claim 9, wherein each of said bias members comprises a leg extended downwardly from the bias member.

11. An outlet strip according to claim 7, wherein said at least one bias member comprises a leaf spring.

12. An outlet strip according to claim 7, wherein said switch comprises an internal breaker circuit.

13. An outlet strip comprising:

at least one receptacle;

means for receiving power from a power source;

a switch coupled between said receptacle and said means for receiving power, said switch operative for controlling power transfer to said at least one receptacle;

a movable member;

a safety key; said safety key having an engaged position and a disengaged position, said safety key in said engaged position operative for positioning said movable member such that said switch is accessible and operable by an operator, said safety key in said disengaged position operative for positioning said movable member such that said switch is inoperable by said operator, and a switch cover for covering said switch, said switch cover having at least one bias member and an actuating member, said actuating member operative for toggling said switch to an OFF position when said switch cover is depressed, said at least one bias member operative maintaining said actuating member above said switch when no pressure is applied to said switch cover.

14. An outlet strip according to claim 13, wherein said safety key comprises a latching member operable with a complementary latch member disposed on a fixed plate within said outlet strip so as to secure said safety key in said engaged position.

15. An outlet strip according to claim 13, wherein said safety key repeatedly movable between said engaged position and said disengaged position.

16. An outlet strip according to claim 13, wherein said movable member prevents said switch from being toggled to an ON position when said safety key is in said disengaged position.

17. An outlet strip according to claim 13, wherein said movable member completely covers said switch such that the switch is inaccessible when said safety key is in said disengaged position.

18. An outlet strip according to claim 13, wherein said switch cover is molded from plastic so as to form a single, unitary member.

19. An outlet strip according to claim 13, wherein said switch cover comprises two bias members, each of which extends substantially parallel to a main body portion of the switch cover.

20. An outlet strip according to claim 13, wherein each of said bias members comprises a leg extended downwardly from the bias member.

21. An outlet strip according to claim 13, wherein said at least one bias member comprises a leaf spring.

22. An outlet strip according to claim 13, wherein said switch comprises an internal breaker circuit.

* * * * *